US009925542B2

(12) United States Patent
Dow et al.

(10) Patent No.: US 9,925,542 B2
(45) Date of Patent: Mar. 27, 2018

(54) PILL CRUSHER, POUCH, AND CORRESPONDING SYSTEMS AND METHODS

(75) Inventors: Rosie A. Dow, Grayslake, IL (US); Kenneth S. Chua, Mundelein, IL (US); John Henry Kutsch, Harvard, IL (US)

(73) Assignee: Medline Industries, Inc., Northfield, IL (US)

( * ) Notice: Subject to any disclaimer, the term of this patent is extended or adjusted under 35 U.S.C. 154(b) by 1735 days.

(21) Appl. No.: 13/156,466

(22) Filed: Jun. 9, 2011

(65) Prior Publication Data

US 2012/0312906 A1 Dec. 13, 2012

(51) Int. Cl.
*B02C 19/08* (2006.01)
*A61J 7/00* (2006.01)

(52) U.S. Cl.
CPC ..... *B02C 19/08* (2013.01); *A61J 7/0007* (2013.01)

(58) Field of Classification Search
CPC ..... B02C 19/08; A61J 7/0007; A47J 43/26
USPC ..... 241/168, DIG. 27, 169, 169.2; 100/292, 100/291, 293, 902; 30/124, 134, 135; 225/103, 104, 96.5, 105; 383/33, 35
See application file for complete search history.

(56) References Cited

U.S. PATENT DOCUMENTS 3,684,156 A * 8/1972 Fettinger et al. ..... 229/240
D268,146 S 3/1983 Rock
5,531,386 A * 7/1996 Jensen ..... 241/36
5,863,001 A * 1/1999 Schulze ..... 241/30
5,915,637 A * 6/1999 Parsons ..... 241/168
6,059,209 A * 5/2000 Barson ..... 241/168
6,557,740 B1 * 5/2003 Dent ..... 225/104
D497,543 S 10/2004 Buckley
6,962,439 B2 * 11/2005 Taheri ..... B65D 33/004 383/204
7,000,815 B1 * 2/2006 Tipton et al. ..... 225/103
7,051,963 B1 * 5/2006 Buckley ..... 241/169
D528,781 S 9/2006 Leyshon et al.
D545,688 S 7/2007 Donovan
D547,674 S 7/2007 Donovan
7,252,254 B1 8/2007 Engel et al.
D551,989 S 10/2007 Engel et al.
7,347,394 B2 * 3/2008 Buckley ..... 241/301
7,364,102 B2 4/2008 Engel et al.
7,407,124 B1 8/2008 Layshon et al.
7,413,137 B2 * 8/2008 Donovan ..... 241/168
7,416,143 B1 * 8/2008 Leyshon et al. ..... 241/168
D579,119 S 10/2008 Engel et al.
D595,147 S 6/2009 Noble
D596,043 S 7/2009 Noble
(Continued)

OTHER PUBLICATIONS

Lane, Sheryl L., "NonFinal Office Action", U.S. Appl. No. 29/393,776, filed Jun. 9, 2011; dated Jan. 5, 2012.
Lane, Sheryl L., "Notice of Allowance", U.S. Appl. No. 29/393,776, filed Jun. 9, 2011; dated May 24, 2012.
"Medline Product—Silent Knight Pill Crushers", Medline Product—Silent Knight Pill Crushers; http://www.medline.com/jum/product/x/Z05-PF10902; Publication date believed to be prior to filing of present application.
(Continued)

*Primary Examiner* — Dmitry Suhol
*Assistant Examiner* — Peter Iannuzzi
(74) *Attorney, Agent, or Firm* — Philip H. Burrus, IV

(57) ABSTRACT

A crushing device (100) is suitable for crushing pills (703), tablets, or other ingestive objects. The crushing device (100) includes a base (101), an anvil (104), an end pillar (105), and a support pillar (106). A threaded shaft (108) is disposed between the anvil (104) and the end pillar (105), and passes through an aperture (107) in the support pillar (106). The threaded shaft (108) is coupled to a crushing head (109), which translates toward the anvil (104) when a lever (110) coupled to the threaded shaft (108) is rotated radially about an axis (301) of the threaded shaft (108). When a pill crushing pouch (500) having pills (703) therein is placed between the crushing head (109) and the anvil (104), rotation of the lever (110) crushes the pills (703).

19 Claims, 8 Drawing Sheets

(56) References Cited

U.S. PATENT DOCUMENTS

| | | | | |
|---|---|---|---|---|
| 7,637,449 | B1 * | 12/2009 | Leyshon et al. | 241/301 |
| 7,648,093 | B2 * | 1/2010 | Kruger | 241/169 |
| D609,010 | S | 2/2010 | Hofer et al. | |
| D620,259 | S | 7/2010 | Fahrendorff et al. | |
| D648,520 | S | 11/2011 | Fahrendorff et al. | |
| D663,120 | S * | 7/2012 | Dow et al. | D3/303 |
| 8,376,256 | B1 * | 2/2013 | Ferguson | 241/169.2 |
| 8,720,808 | B2 * | 5/2014 | Young et al. | 241/169.2 |
| 2006/0043224 | A1 * | 3/2006 | Weisbeck | 241/169.2 |
| 2006/0113411 | A1 | 6/2006 | Buckley | |
| 2007/0297701 | A1 * | 12/2007 | Engel et al. | 383/104 |
| 2009/0097786 | A1 * | 4/2009 | Goglio | B65D 75/008 383/211 |
| 2012/0141048 | A1 * | 6/2012 | Ribi | B65D 33/30 383/35 |
| 2012/0256024 | A1 * | 10/2012 | Engel et al. | 241/26 |

OTHER PUBLICATIONS

"MedlineProduct—Silent KNight Pill Crusher Pouch", MedlineProduct—Silent Knight Pill Crusher Pouch; http://medline.com/product/Silent-Knight-PillCurhser-Pouches/Z05-PF-10901; Publication date unknown but believed to be prior to present application.

"Medline Producet—Pill Crushers", Medline Pill Crushers; Blue Individual NON13400 ; http://www.shoplet.com/Medline-Pill-Crushers/NON134000/spdv; publication date unknown but believed to be prior to present application.

"Medline Product", Medline Product; Die Cast Chrome Pill Crusher; http://www.staples.com/Medline-Die-Cast-Chrom-Pill-Crushers/product_113447; publication date unknown but believed to be prior to filing of present application.

"Medline Catalog", Automated Pill Crusher by Patterson Medi; SNR081540889; http://www.medline.com/product/Automated-Pill-Crusher-By-Patterson...rushers/Z05-PF56230?question=pill+crusher&index=P43&indexCount=43; Publication date unknown but believed to be prior to present application.

"Medline Catalog", Bags for Pill Crusher PC Pouch by Cardinal Health; BXTPC1000; http://www.medline.com/product/Bags-for-Pill-Crusher-PC-Pouch-by-C...rushers/Z05-PF53059?question=pill+crusher&indexCount=40; Publication date unknown but believed to be prior to present application.

"Medline Catalog", Deluxe Cut N' Crush Pill Pouch; APY67750 and APY67750H; http://www.medline.com/product/Deluxe-Cut-N-Crush-Pill-Crusher/Pill...s/Crushers/Z05-PF10895?question=pill+crusher&index=P8&indexCount=8; Publication date unknown but believed to be prior to present application.

"Medline Catalog", Ezy-Dose Tablet Cutters by Apothecary Products; APY67015BC; http://www.medline.com/product/Ezy-Dose-Tablet-Cutters-by-Apotheca...rushers/Z05-PF47212?question=pill+crusher&index=P19&indexCount=19; Publication Date unknown but believed to be prior to present application.

"Medline Catalog", HealthSmart Pill Cutter by Briggs Healthcare; MBH4054370000; http://www.medline.com/product/HealthSmart-Pill-Cutter-by-Briggs-H...Crushers/Z05-PF37868?question=pill+crusher&index=P12&indexCount=12; Publication Date unknown but believed to be prior to present application.

"Medline Catalog", Liquid Nitrogen Cooled Mini Mortar by Be; BRT372600100; http://www.medline.com/product/Liquid-Nitrogen-Cooled-Mini-Mortar-...rushers/Z05-PF68072?question=pill+crusher&index=P36&indexCount=36; Publication Date unknown but believed to be prior to present application.

"Medline Catalog", Mortar and Pestle Pill Crushers; HCL14075, HCL3073, HCL3075, HCL3398; http://www.medline.com/product/Mortar-and-Pestle-Pill-Crushers/Pill.../Crushers/Z05-PF10897?question=pill+crusher&index=P26&indexCount=26; Publication Date unknown but believed to be prior to presnt application.

"Medline Catalog", Pill Crusher/Splitter by Graham-Field; GHF5713; http://www.medline.com/product/Pill-Crusher/Splitter-by-Graham-Fiel...Crushers/Z05-PF60151?question=pill+crusher&index=P16&indexCount=16; Publication date unknown but believed to be prior to present application.

"Medline Catalog", Pill Crusher/Tablet Crusher Pouches by RD Plastics; RDPG600; http://www.medline.com/product/Pill-Crusher/Tablet-Crusher-Pouches...Crushers/Z05-PF80049?question=pill+crusher&index=P14&indexCount=14; Publication date unknown but believed to be prior to present application.

"Medline Catalog", Pill Crusher and Pill Cutter by Tech-Med; NDA6340 and NDA6341; http://www.medline.com/product/Pill-Crusher-and-Pill-Cutter-by-Tech...Crushers/Z05-PF96490?question=pill+crusher&index=P23&indexCount=23; Publication date unknown but believed to be prior to present application.

"Medline Catalog", Pill Crushers by Healthcare Logistics; HET700111B; http://www.medline.com/product/Pill-Crushers-By-Healthcare-Logistic...Crushers/Z05-PF61058?question=pill+crusher&index=P11&indexCount=11; Publication date unknown but believed to be prior to present application.

"Medline Catalog", Pill Cutter by Graham-Field; GHF5711; http://www.medline.com/product/Pill-Cutter-by-Graham-Field/Pill-Cut...Crushers/Z05-PF60152?question=pill+crusher&index=P18&indexCount=18; Publication date unknown but believed to be prior to present application.

"Medline Catalog", Pill Spliiter by Sammons and Preston; SNRC3458; http://www.medline.com/product/Pill-Splitter-by-Sammons-and-Presto...Crushers/Z05-PF63720?question=pill+crusher&index=P41&indexCount=41; Publication date unknown but believed to be prior to present application.

"Medline Catalog", Pill Splitters; NON135000; http://www.medline.com/product/Pill-Splitters/Pill-Cutters/Crushers/Z05-PF10900?question=pill+crusher&index=P2&indexCount=2; Publication Date Unknown but believed to be prior to present application.

"Medline Catalog", Printed Pill Envelope by Graham-Field; GHF9600; http://www.medline.com/product/Printed-Pill-Envelope-by-Graham-Fie...Crushers/Z05-PF60153?question=pill+crusher&index=P21&indexCount=21; Publication Date Unknown but believed to be prior to present application.

"Medline Catalog", Safety Shield tablet Cutter by Apothecary Products; APY67856; http://www.medline.com/product/Safety-Shield-Tablet-Cutter-by-Apot...s/Crushers/Z05-PF61899?question=pill+crusher&index=P7&indexCount=7; Publication Date Unknown but believed to be prior to present application.

"Medline Catalog", Silent Knight Pill Crusher Pouches; NONPC1000 and NONPC1000Z; http://www.medline.com/product/Silent-Knight-Pill-Crusher-Pouches/Z05-PF10901; Publication Date Unknown but believed to be prior to present application.

"Medline Catalog", Silent Knight Pill Crushers; NONSK0100; http://www.medline.com/jump/product/x/Z05-PF10902; Publication Date unknown but believed to be prior to present application.

"Medline Catalog", Tablet Crushers by Apothecary Products; APY63002 and APY71091; http://www.medline.com/product/Tablet-Crushers-by-Apothecary-Produ...rushers/Z05-PF10903?question=pill+crusher&index=P20&indexCount=20; Publication Date unknown but believed to be prior to present application.

"Medline Catalog", Ultra Pill Crusher by Patterson Medical; SNR567087; http://www.medline.com/product/Ultra-Pill-Crusher-By-Patterson-Medi...Crushers/Z05-PF56385?question=pill+crusher&index=P42&indexCount=42; Publication date unknown but believed to be prior to present application.

"Medline Catalog", PillCrushProducts; http://www.medline.com/product/Deluxe-Cut-N-Crush-Pill-Crusher/Pill-Cutters/Crushers/Z05-PF10895?question=pill+crusher&index=P8&indexCount=8; Publication Date Unknown but believed to be prior to present application.

* cited by examiner

PILL CRUSHER, POUCH, AND CORRESPONDING SYSTEMS AND METHODS

BACKGROUND

Technical Field

This invention relates generally to systems and methods for crushing pills, tablets, and other solid ingestive objects, and more particularly to a pill crushing device and pouch, and corresponding methods.

Background Art

Medicines, vitamins, supplements, and other similar compressed ingestive items are frequently sold in the form of pills or solid tablets. It is sometimes the case a person is unable to ingest the tablet or pill in its original form. For example, some people simply recoil at the thought of swallowing a solid object. Others might be leery of the pill possibly "sticking" in the throat while being swallowed. In other cases, a pill or tablet may simply be tool large for a person to comfortably swallow. Some types of users, such as children or geriatric users, may simply have difficulty swallowing a pill or tablet regardless of size. Pill crushers can be utilized to crush the pills or tablets into particulate or powder form. The crushed pill or tablet can then be mixed with a food or liquid for easier ingestion.

Some pill crushers exist on the market today. For example, U.S. Pat. No. 7,347,394 to Buckley, entitled "Pill Crusher Pouch and Method of Using Same," discloses one such device. Such devices suffer from deficiencies. For example, Buckley's device makes a loud noise when in operation. For each pill crushed, a large "KERRR-CHUNK - - - SHKKKK" sound is emitted. Pill crushers are frequently used in quiet environments, such as hospitals and nursing homes. Emission of audible noise can be irritating and disruptive, waking patients and limiting the number of locations in which the pill crusher can be used.

It would be advantageous to have a pill crusher that overcomes the deficiencies of prior attempts, and that operates in an easy, reliable, quiet, and efficient manner.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIGS. 7-10, viewed collectively, illustrate a method for crushing a pill in accordance with one or more embodiments of the invention.

Figure 1:
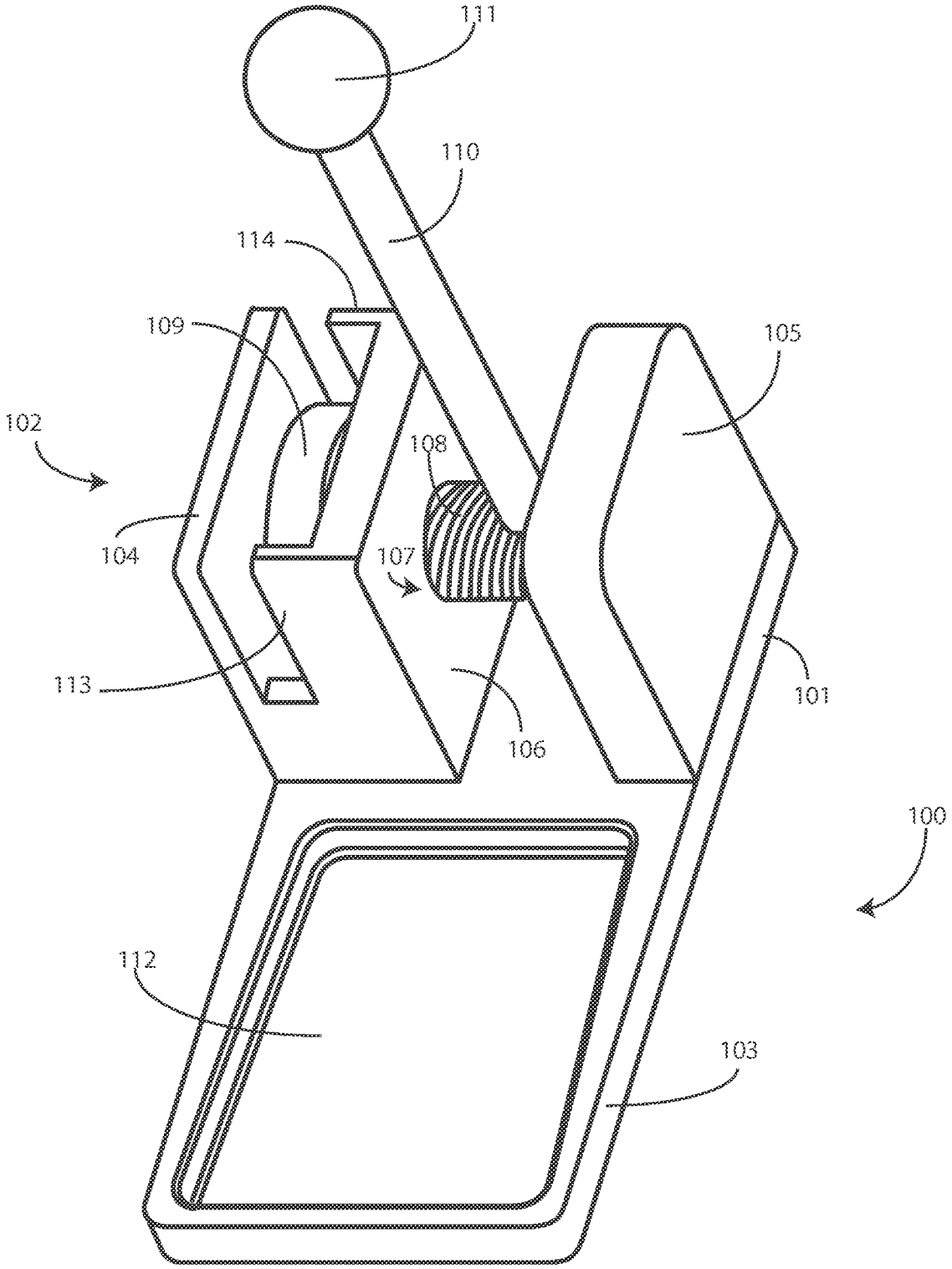
FIG. 1 illustrates a perspective view of one illustrative pill crusher configured in accordance with embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Before describing in detail embodiments that are in accordance with the present invention, it should be observed that the embodiments reside primarily in combinations of method steps and apparatus components related to crushing pills, tablets, or other solid objects. Alternate implementations are included, and it will be clear that functions may be executed out of order from that shown or discussed, including substantially concurrently or in reverse order, depending on the functionality involved. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, any reference designators shown herein in parenthesis indicate components shown in a figure other than the one in discussion. For example, talking about a device (10) while discussing figure A would refer to an element, 10, shown in figure other than figure A.

Referring to FIGS. 1-4, illustrated therein is a crushing device 100, configured in accordance with one or more embodiments of the invention, and suitable for crushing pills, tablets, and other similar objects. The crushing device 100 can be made of a rigid material, such as a metal or alloy.

Alternatively, some or all of the components of the crushing device can be manufactured from other materials, including composites, plastics, and so forth.

The crushing device 100 consists generally of a base 101 and a crushing assembly 102. The crushing assembly 102 extends upwardly from the base 101, which provides mechanical support for the crushing assembly 102 when in operation. In the illustrative embodiment shown in FIGS. 1-4, the base 101 is "one sided" in that it includes a base extension 103 that extends outwardly from the crushing assembly 102 in only one direction. In this embodiment, the one direction extends outwardly from the crushing assembly 102 along the first plane 201. In other embodiments, the base extension 103 can be configured to extend outwardly in two, three, four, or more directions from the crushing assembly 102 as well.

Figure 2:
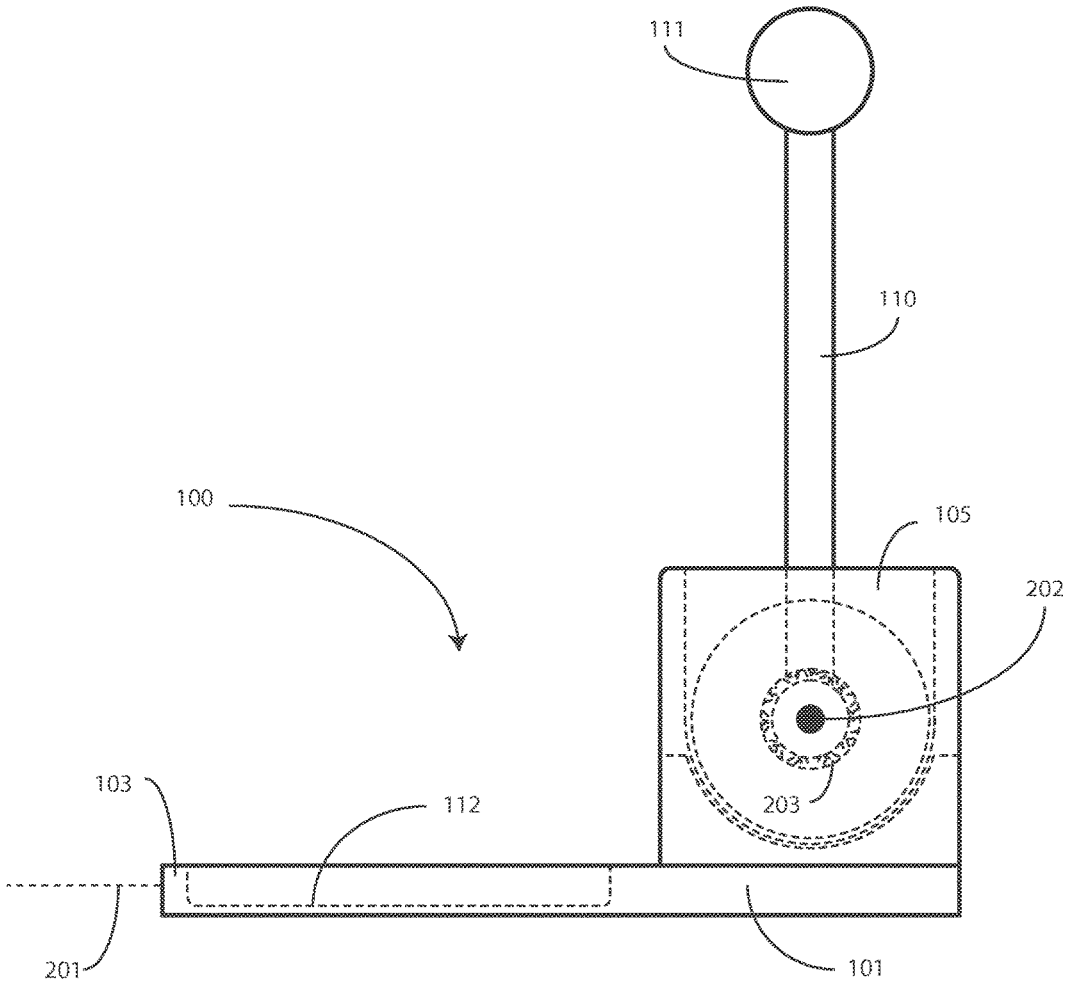
FIG. 2 illustrates a side, elevation view of one illustrative pill crusher configured in accordance with embodiments of the invention.
Figure 3:
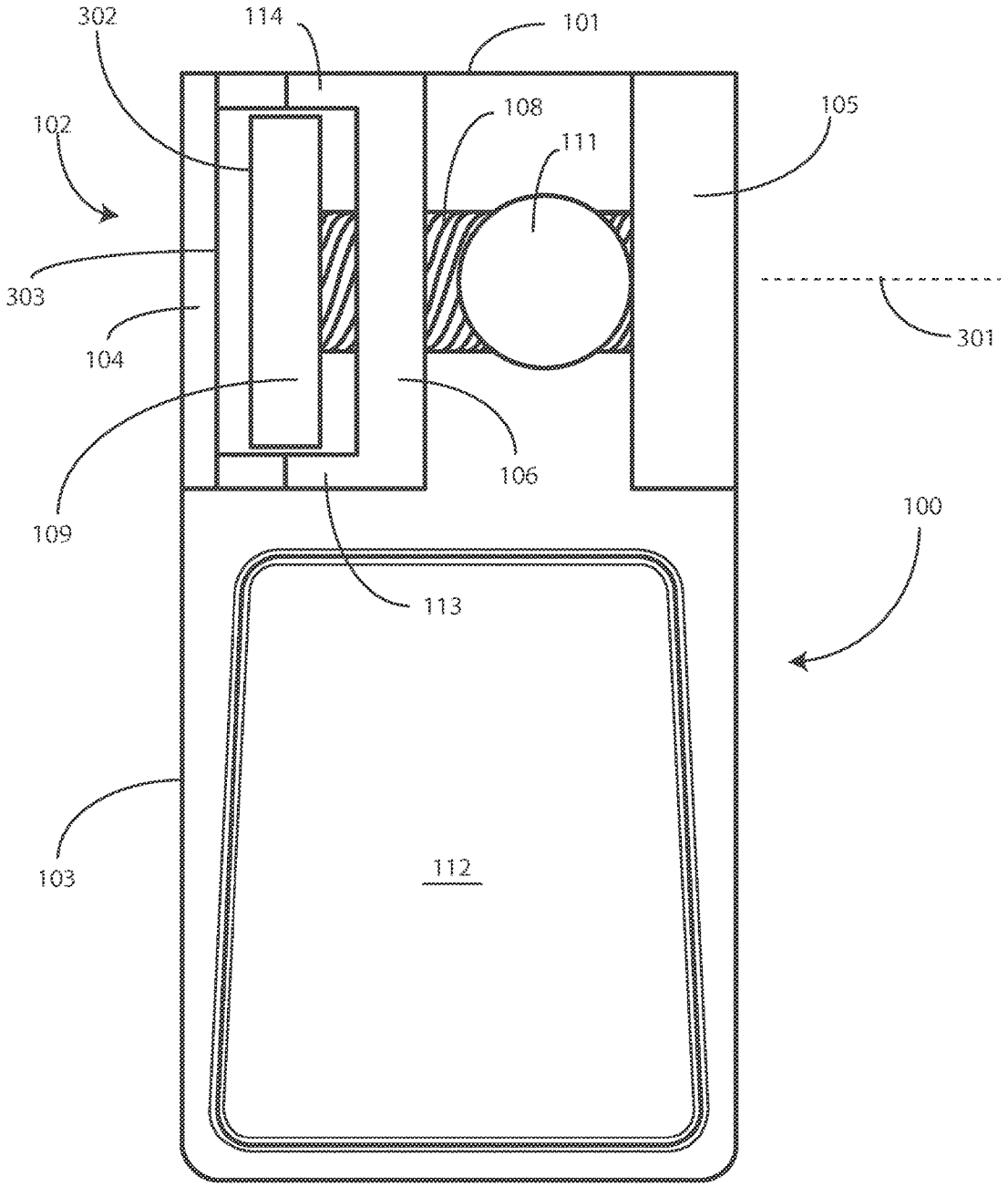
FIG. 3 illustrates a top, plan view of one illustrative pill crusher configured in accordance with embodiments of the invention.
Figure 4:
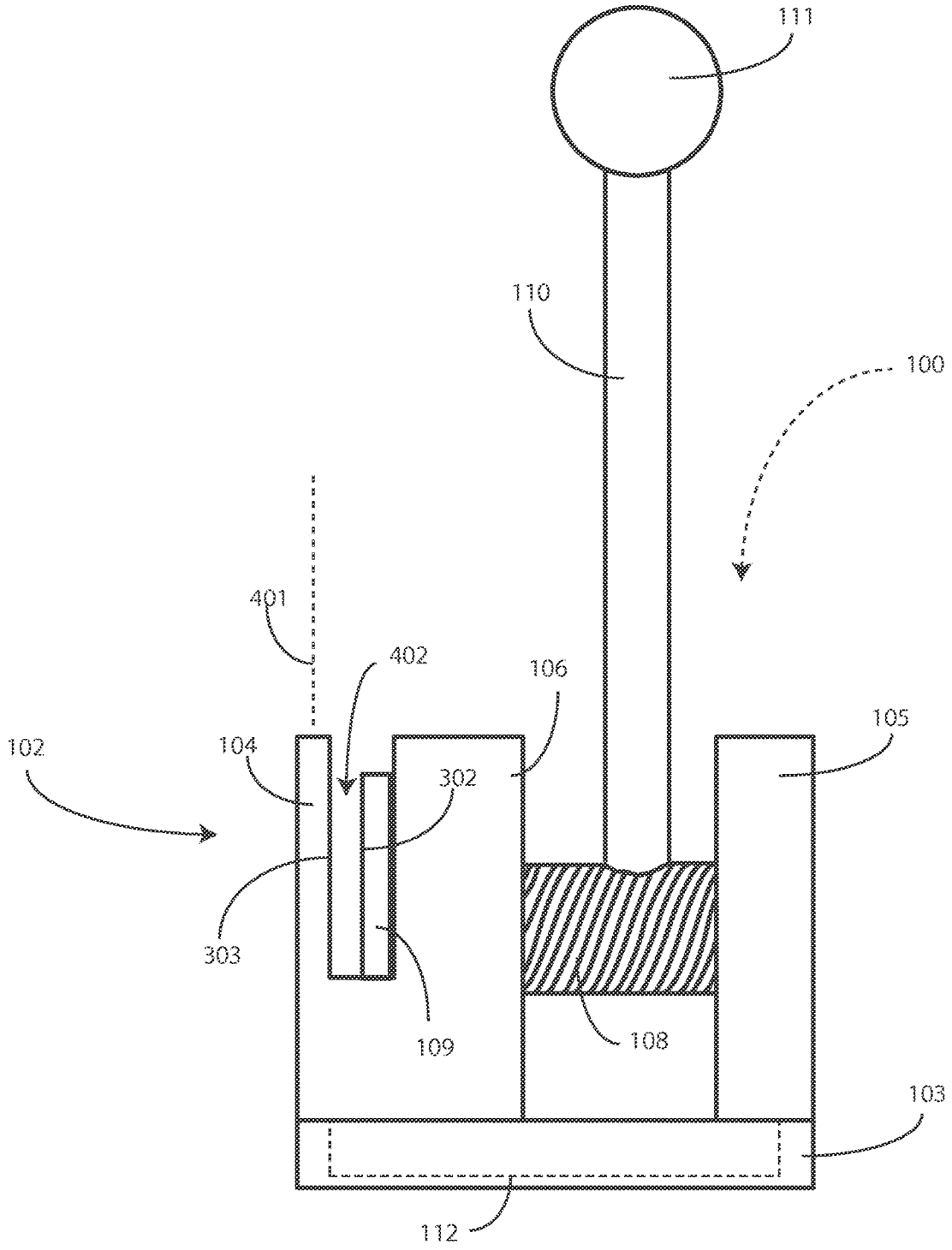
FIG. 4 illustrates a front, elevation view of one illustrative pill crusher configured in accordance with embodiments of the invention.

In one embodiment, the crushing assembly 102 comprises an anvil 104, an end pillar 105, and a support pillar 106. Each of the anvil 104, the end pillar 105, and the support pillar 106 extend upwardly and away from the base 101. In one embodiment, the crushing assembly 102 extends substantially orthogonally upward from the base 101. For example, in the illustrative embodiment of FIGS. 1-4, the base 101 is oriented along a first plane 201, which is a first theoretical reference and is shown in FIG. 2. The anvil 104, in this illustrative embodiment, extends from the base 101 and is oriented along a second plane 401, which is a second theoretical reference and is shown in FIG. 4. In one embodiment, the first plane 201 and the second plane 401 are oriented substantially orthogonally relative to each other. The term "substantially" is used to refer to a relationship that is inclusive of manufacturing and design tolerances. For example, a "substantially orthogonal" angle could be 89.123, 88.926, 90.92, etc., where the difference between the actual angle and the orthogonal angle is due to tolerances associated with part design, part fabrication, assembly, manufacture, and so forth.

In one embodiment, both the end pillar 105 and the support pillar 106 are oriented substantially parallel with the second plane 401. The support pillar 106 can be disposed between the anvil 104 and the end pillar 105. In one embodiment, the anvil 104 and the end pillar 105 are disposed on or aligned with opposite edges of the base 101, as shown in FIGS. 1-4.

In one embodiment, the end pillar 105 includes a pivot 202. The support pillar 106 includes an aperture 107 that is substantially aligned with the pivot 202. A threaded shaft 108 can be disposed within the aperture 107 with an end of the threaded shaft 108 being disposed within the pivot 202 such that the threaded shaft 108 terminates at the pivot 202 and extends through the aperture 107. In this configuration, the support pillar 106 provides vertical, an optionally horizontal (lateral) support for the threaded shaft 108. The support pillar 106 can optionally include a mechanical stop (not shown) configured to retain the threaded shaft 108 between the support pillar 106 and the end pillar 105. Either or both of the support pillar 106 and end pillar 105 can be configured as bifurcated components that "sandwich" the threaded shaft 108 within the aperture 107 or pivot 202, respectively.

The threaded shaft 108 defines an axis 301. The axis 301 is a third theoretical reference, and is shown illustratively in FIG. 3. In one embodiment, the axis 301 is oriented substantially orthogonally with the second plane 401. In one embodiment, the axis 301 is oriented substantially orthogonally with the anvil 104, end pillar 105, and support pillar 106. In one embodiment, the axis 301 is oriented substantially centrally along each of the anvil 104, end pillar 105, and support pillar 106. Such a configuration is shown in FIGS. 1-4. It will be clear to those of ordinary skill in the art having the benefit of this disclosure that embodiments of the invention are not so limited, however. For example, while the anvil 104, end pillar 105, and support pillar 106 are illustratively shown as being square in cross section, with the axis 301 oriented in a substantially central location, other configurations could be used as well. The anvil 104, end pillar 105, and support pillar 106 could be rectangular, oval, triangular, trapezoidal, etc., with the axis 301 oriented in non-central locations as well.

While one end of the threaded shaft 108 terminates at the pivot 202, the opposite end of the threaded shaft 108 terminates at a crushing head 109. In the illustrative embodiment of FIGS. 1-4, the crushing head 109 is disk-shaped in cross section, as can be seen in FIG. 1. The crushing head 109 includes a crushing surface 302. In one embodiment, the crushing surface 302 is planar, and is oriented in a co-planar relationship with the second plane 401. Where the anvil 104 includes a corresponding crushing surface 303, the surfaces can interface along a broad, planar surface. In other embodiments, one or more of the crushing surfaces 302,303 can be textured, include mechanical crushing features, or take other shapes as desired to alter the crushing process.

A lever 110, which terminates in a spherical handle 111 in one embodiment, is coupled to and extends from the threaded shaft 108. The lever 110 is used to actuate the crushing head 109. This occurs as follows: when the crushing device 100 is not in use, the lever 110 is placed in an "open position." The placement is referred to as "open" because the crushing head 108 is retracted from the anvil 104, thereby allowing an object to be crushed to be inserted therebetween. In the illustrative embodiment of FIGS. 1-4, the open position occurs where the lever 110 is oriented substantially orthogonally with the first plane 201. It will be clear to those of ordinary skill in the art that other orientations could define the open position as well.

When the lever 110 is rotated in a first direction, the threaded shaft 108 rotates about the axis 301. This rotation causes the threaded shaft 108 to translate outwardly from the pivot 202, through the aperture 107 and toward the anvil 104. Since the threaded shaft 108 is coupled to the crushing head 109, the crushing head 109 both rotates about the axis 301 and translates along the axis 301 toward the anvil 104. In the illustrative embodiment of FIGS. 1-4, rotation in the first direction involves rotating the lever 110 radially about the axis 301 from the open position toward the base extension 103.

When the process is executed in reverse, the crushing head 109 rotates in the opposite direction about the axis 301 and retracts from the anvil 104. Said differently, in one embodiment the threaded shaft 108 is configured to both rotate the crushing head 109 about the axis 301 of the threaded shaft 108 and translate the crushing head 109 away from the anvil 104 along the axis 301 of the threaded shaft 108 when the lever 110 is rotated in a second direction about the axis 301. In the illustrative embodiment of FIGS. 1-4, the second direction is away from the base extension 103 and towards the open position.

In one embodiment, a resilient component 203, such as a spring, compression member, hydraulic release, or other similar device, is included. The resilient component 203 can be integrated with the end pillar 105, the support pillar 106, or both. In one embodiment, the resilient component 203 is configured to bias the lever 110 toward the open position. Accordingly, when a user actuates the crushing head 109 by rotating the lever 110 toward the base extension 103, rather than having to manually rotate the lever 110 back to the open position, the resilient component 203 can perform the opening operation automatically. Accordingly, the user is simply able to release the lever 110 once the pill or tablet has been crushed between the crushing surfaces 302,303 of the crushing head 109 and the anvil 104, respectively. The inclusion of a resilient component 203 is optional.

In one embodiment, the crushing device 100 can be used with a pill crushing pouch, which is described in more detail below with reference to FIGS. 5-7 below. In one embodiment, to provide storage for the pill crushing pouches or other objects, the base extension 103 can be configured with a storage well 112. Where the storage well 112 is for use with pouches, the storage well 112 can be geometrically designed with a shape that is similar to the pouches. For example, in the illustrative embodiment of FIGS. 1-4, the storage well 112 has a trapezoidal cross section along the first plane 201, which is best seen when viewing the second plane in the plan view of FIG. 3. The storage well 112 can be configured with other shapes as well.

An optional feature that can be included in one or more embodiments is a head crushing shroud. In the illustrative embodiment of FIGS. 1-4, the head crushing shroud is configured as a first shroud member 113 and a second shroud member 114 that each project from the support pillar 106 toward the anvil 104. In the illustrative embodiment shown, the first shroud member 113 and the second shroud member 114 are disposed on opposite sides of the crushing head 109, which is to the front and to the rear of the crushing head 109. Other configurations can be used as well, such as including a third shroud member (not shown) that is disposed above the crushing head 109. When the lever 110 is in the open position, the crushing head 109 retracts into the crushing shroud, which in this embodiment consists of retracting toward the support pillar 106 and between at least portions of the first shroud member 113 and the second shroud member 114.

In one embodiment, the support pillar 106, the anvil 104, and the head crushing shroud are integrated into a singular unit, as is shown in FIGS. 1-4. In another embodiment, the anvil 104, support pillar 106, head crushing shroud, and end pillar 105 can be integrated into a singular unit as well.

In one embodiment, the anvil 104 and support pillar 106 define a pill crushing pouch insertion aperture 402 into which a pill crushing pouch may be inserted. In the illustrative embodiment of FIGS. 1-4, the pill crushing pouch insertion aperture is defined between the head crushing shroud and the anvil 104. When a pill crushing pouch is inserted into the pill crushing pouch insertion aperture, at least a portion of the pouch becomes disposed between the anvil 104 and the crushing head 109 such that pills or tablets disposed within the pouch can be crushed between the crushing surfaces 302,303.

Figure 5:
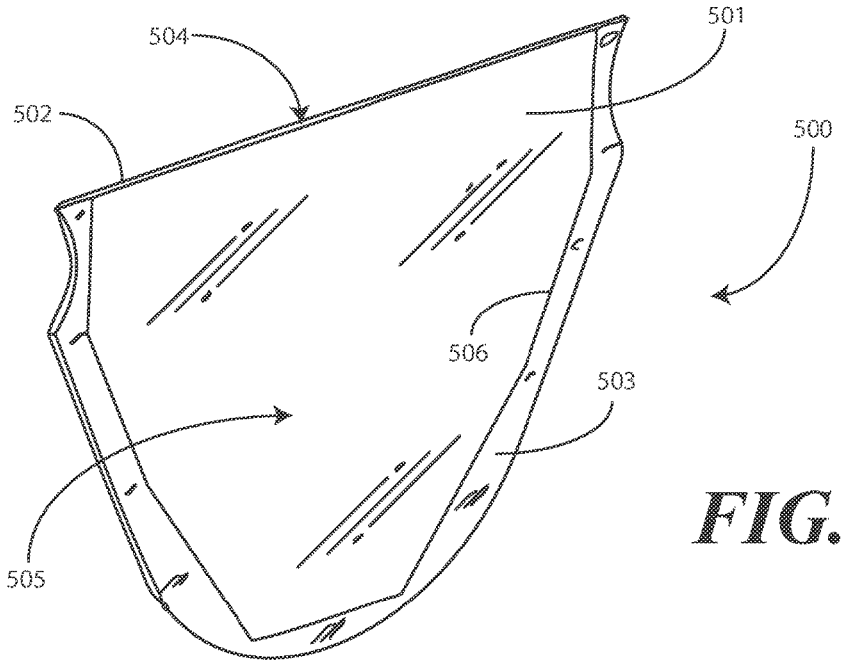
FIG. 5 illustrates a perspective view of an illustrative pouch configured for use with one illustrative pill crusher configured in accordance with embodiments of the invention.
Figure 6:
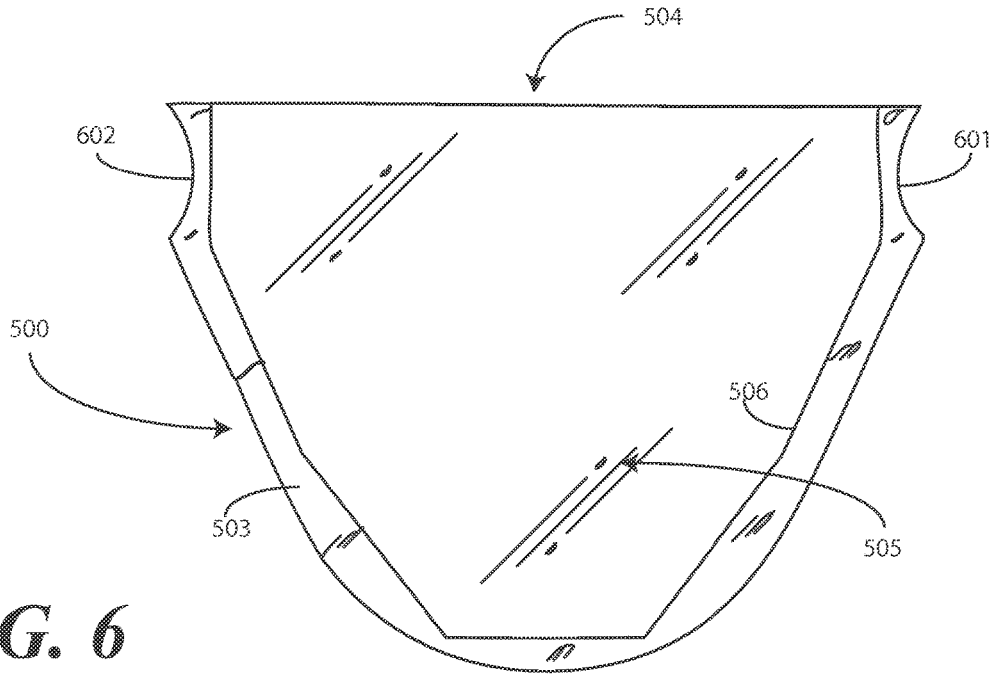
FIG. 6 illustrates a front, elevation view of an illustrative pouch configured for use with one illustrative pill crusher configured in accordance with embodiments of the invention.

Turning now to FIGS. 5 and 6, illustrated therein is one embodiment of a pill crushing pouch 500 configured for use with a crushing device (100) configured in accordance with one or more embodiments of the invention. In one embodiment, the pill crushing pouch 500 is manufactured from a first layer 501 of material and a second layer 502 of material. In one embodiment, the material is pellucid or translucent so that pills or tablets inserted therein can be readily seen. For example, in one embodiment the material is clear polyethylene. Other flexible, sturdy materials with behavioral characteristics similar to polyethylene can also be used.

In one embodiment, the first layer 501 and the second layer 502 are bonded together, such as with a thermal bonding process, a mechanical press bonding process, an ultrasonic bonding process, adhesive bonding process, or other similar process. In the illustrative embodiment of FIGS. 5 and 6, the first layer and second layer 502 are bonded together so as to define an enclosing seam 503, an insertion aperture 504, and a receiving pouch 505. In one illustrative embodiment, the enclosing seam defines a piecewise linear boundary 506 of straight line segments about the interior of the receiving pouch 505. For example, as can be seen in FIG. 6, this illustrative pill crushing pouch 500 includes a seven-line segment piecewise linear boundary 506.

In one embodiment, exterior features are formed into the seam 503 as well. For example, in one embodiment the seam 503 includes a plurality of finger recesses 601,602 that can be advantageously used to open the insertion aperture 504. Turning now to FIG. 7, this can be more readily seen.

Figure 7:
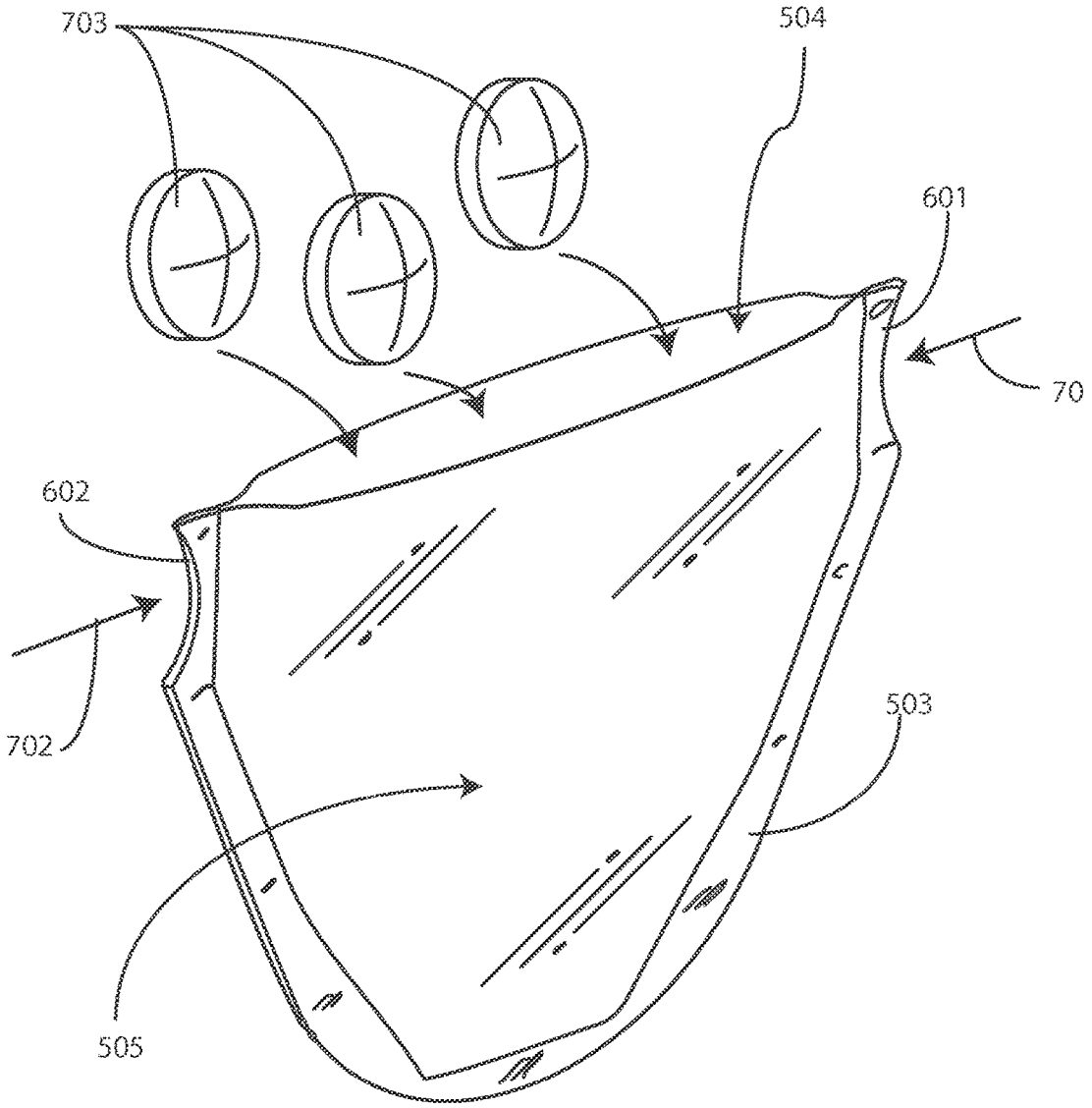
FIG. 7 illustrates one pouch configured for use with the invention in use.

A user grasps the finger recesses 601,602 and presses them together in the directions 701,702 shown in FIG. 7. As the seam 503 in this illustrative embodiment is formed from two layers of the material, while the sides of the receiving pouch 505 comprise a single layer of the material, the seam 503 is more rigid than are the sides. Accordingly, when the user squeezes the finger recesses 601,602 together, the stiffness of the seam 503 causes the insertion aperture 504 to open. This allows one or more pills 703 to be quickly and easily inserted. The finger recesses 601,602 also work to prevent the spillage of any pills 703 or medicine, which could be costly.

Turning now to FIGS. 7-10, illustrated therein is a graphical representation of the steps of a method of crushing pills or tablets using a crushing device 100 and a pill crushing pouch 500 as previously described. Beginning at FIG. 7, a user obtains a pill crushing pouch 500. The user may optionally employ one or more finger recesses 601,602 by squeezing them together to open an insertion aperture 504. One or more pills 703 can then be placed or inserted within the pill receiving pouch 500.

Figure 8:
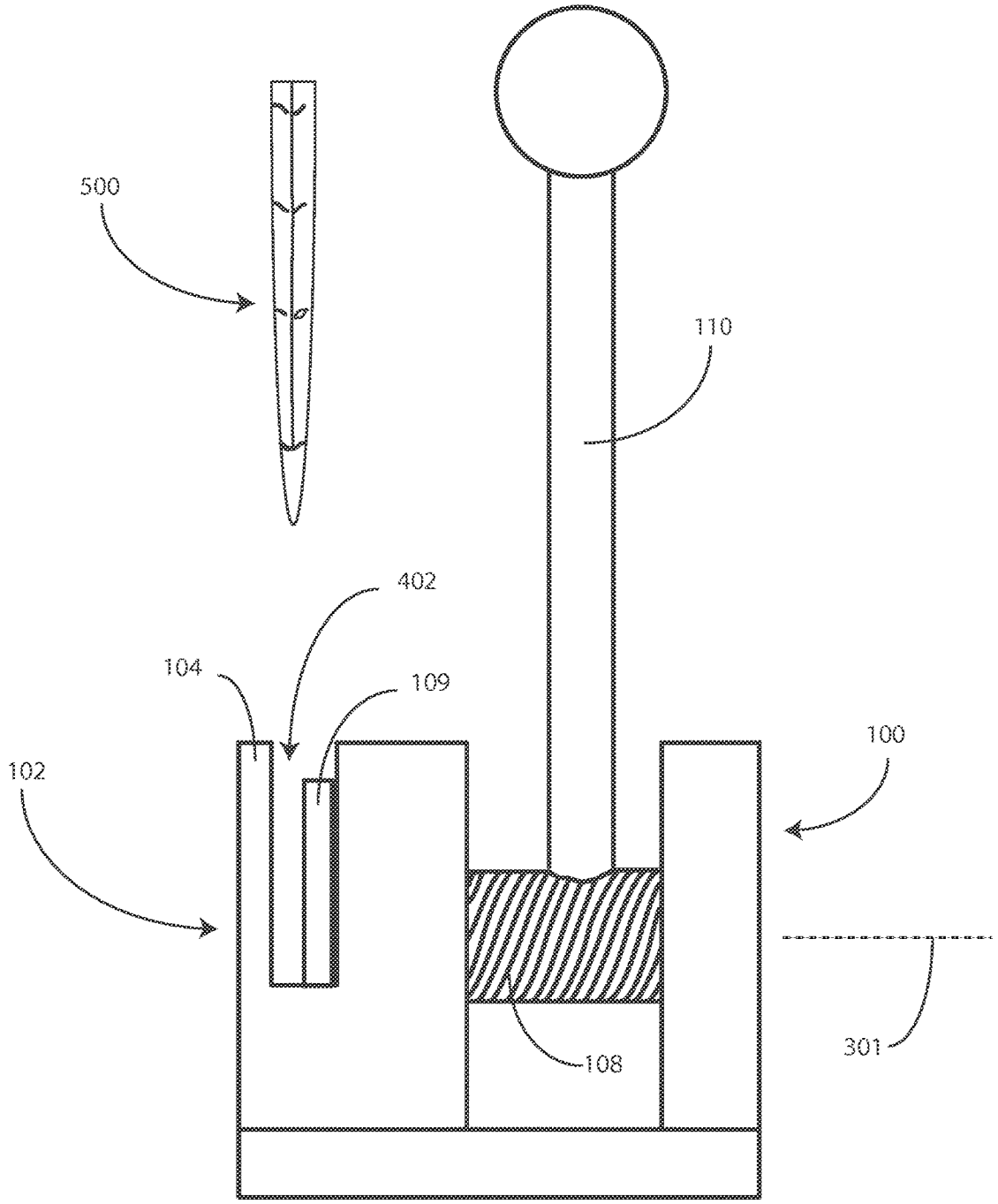
FIGS. 8 and 9 illustrate one illustrative pill crushing system configured in accordance with one or more embodiments of the invention while in use.
Figure 9:
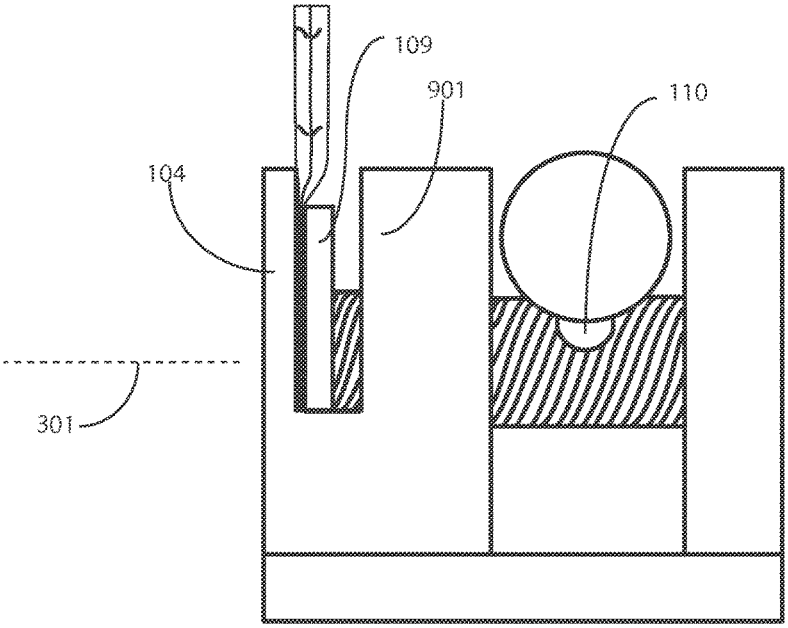

As shown in FIG. 8, the user may then place the pill crushing pouch 500 within a pouch receiving aperture 402 disposed between an anvil 104 and a crushing head 109 of a crushing assembly 102 in the crushing device 100. The user may then rotate the lever 110 radially about the axis 301 of a threaded shaft, thereby causing the crushing head 109 to rotate about the axis 301 and to translate toward the anvil 104 to crush the pill (703). While FIG. 8 illustrates the lever 110 being in the open position, FIG. 9 illustrates the lever 110 being in the closed position with the crushing head 109 having fully crushed the pills (709) against the anvil 104. The user may then rotate the lever 110 radially in reverse about the axis 301 (this can optionally be accomplished by a resilient component (203)), thereby causing the crushing head 109 to withdraw from the anvil 104 into a head crushing shroud 901 extending from the support pillar 106.

Figure 10:
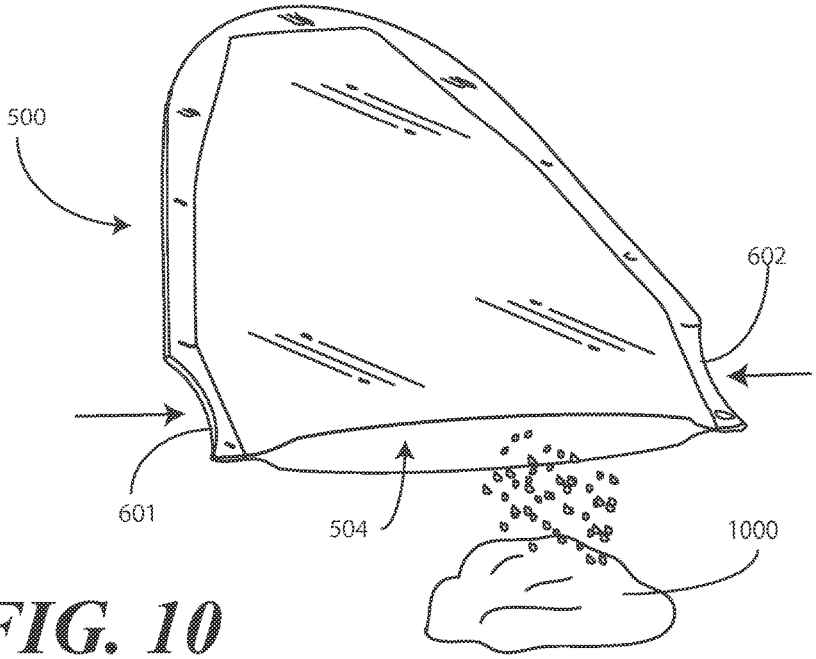
FIG. 10 illustrates the result of a pill or tablet being crushed by an illustrative pill crushing system configured in accordance with one or more embodiments of the invention.

As shown in FIG. 10, the pill crushing pouch 500 can be withdrawn from the pouch receiving aperture (402). The contents 1000 can be emptied by pressing the finger recesses 601,602 together, thereby opening the insertion aperture 504.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A crushing device, comprising:

a base oriented along a first plane; and a crushing assembly, the crushing assembly comprising:

an anvil extending from the base and oriented along a second plane substantially orthogonally with the first plane;

an end pillar comprising a pivot and extending from the base opposite the anvil;

a support pillar extending from the base between the anvil and the end pillar;

a crushing head having a crushing surface, the crushing head comprising a disk-shaped cross section;

a threaded shaft coupled to the crushing head, disposed within an aperture of the support pillar, terminating at the pivot, and having an axis oriented substantially orthogonally with the second plane; and a lever coupled to the threaded shaft;

wherein the threaded shaft is configured to both rotate the crushing head about the axis and translate the crushing head toward the anvil along the axis when the lever is rotated in a first direction about the axis.

2. The crushing device of claim 1, wherein the threaded shaft is configured to both rotate the crushing head about the axis of the threaded shaft and translate the crushing head away from the anvil along the axis of the threaded shaft when the lever is rotated in a second direction about the axis.

3. The crushing device of claim 1, wherein the base comprises a base extension extending from one side of the crushing assembly in the first plane.

4. The crushing device of claim 3, wherein the base extension comprises a storage well.

5. The crushing device of claim 4, wherein the storage well comprises a trapezoidal cross section in the first plane.

6. The crushing device of claim 3, wherein the lever is in an open position when the lever is oriented substantially orthogonal with the first plane.

7. The crushing device of claim 6, wherein the first direction comprises radial movement of the lever from the open position toward the base extension.

8. The crushing device of claim 6, further comprising a resilient component configured to bias the lever toward the open position.

9. The crushing device of claim 1, wherein the crushing surface is planar and is oriented in a coplanar orientation relative to the first plane.

10. The crushing device of claim 1, wherein the support pillar comprises a head crushing shroud.

11. The crushing device of claim 10, wherein the head crushing shroud projects from the support pillar towards the anvil on opposite sides of the crushing head.

12. The crushing device of claim 11, wherein the anvil, the support pillar, and the head crushing shroud are integrated into a singular component, the anvil and the head crushing shroud defining a three-sided pill crushing pouch insertion aperture into which a pill crushing pouch may be inserted such that the pill crushing pouch is disposed between the anvil and the crushing head.

13. The crushing device of claim 1, wherein the lever terminates in a spherical handle.

14. A pill crushing pouch configured for use with a crushing device, the pill crushing pouch comprising:

a first layer and a second layer, coupled together to define an enclosing seam, an insertion aperture, and a receiving pouch;

the enclosing seam defining a piecewise linear boundary about the receiving pouch; and the enclosing seam defining a plurality of finger recesses.

15. The pill crushing pouch of claim 14, wherein the piecewise linear boundary comprises a seven-line segment boundary.

16. The pill crushing pouch of claim 14, the plurality of finger recesses to open the insertion aperture when squeezed together.

17. A method of crushing a pill, comprising:

placing a pouch having an enclosing seam defining a plurality of finger recesses in a crushing assembly comprising:

an anvil;

an end pillar;

a support pillar disposed between the anvil and the end pillar;

a crushing head having a crushing surface;

a threaded shaft having an axis, coupled to the crushing head, and disposed within an aperture of the support pillar and terminating at the end pillar; and rotating a lever coupled to the threaded shaft radially about the axis, thereby causing the crushing head to rotate about the axis and to translate toward the anvil to crush the pill.

18. The method of claim 17, further comprising:

obtaining the pouch, wherein the pouch comprises:

a first layer and a second layer, coupled together to define the enclosing seam, an insertion aperture, and a receiving pouch;

squeezing the plurality of finger recesses to open the insertion aperture;

inserting the pill in the pouch.

19. The method of claim 17, further comprising rotating the lever radially in reverse about the axis, thereby causing the crushing head to withdraw from the anvil into a head crushing shroud extending from the support pillar.

* * * * *